US009480877B2

(12) United States Patent
Chiang et al.

(10) Patent No.: US 9,480,877 B2
(45) Date of Patent: Nov. 1, 2016

(54) EXERCISE DEVICE PROVIDING SYMMETRY INDEX

(71) Applicant: DYACO INTERNATIONAL INC., Taipei (TW)

(72) Inventors: Hao Chiang, Taipei (TW); Brian Murray, Taipei (TW)

(73) Assignee: DYACO INTERNATIONAL INC., Taipei (TW)

( * ) Notice: Subject to any disclaimer, the term of this patent is extended or adjusted under 35 U.S.C. 154(b) by 415 days.

(21) Appl. No.: 14/207,049

(22) Filed: Mar. 12, 2014

(65) Prior Publication Data

US 2015/0174447 A1 Jun. 25, 2015

(30) Foreign Application Priority Data

Dec. 20, 2013 (TW) ..... 102147450 A

(51) Int. Cl.

| | |
|---|---|
| ***A63B 24/00*** | (2006.01) |
| ***A63B 22/06*** | (2006.01) |
| *A63B 21/008* | (2006.01) |
| *A63B 21/015* | (2006.01) |
| *A63B 21/22* | (2006.01) |
| *A63B 22/00* | (2006.01) |
| *A63B 71/06* | (2006.01) |

(52) U.S. Cl.

CPC ..... *A63B 24/00* (2013.01); *A63B 22/0605* (2013.01); *A63B 21/008* (2013.01); *A63B 21/015* (2013.01); *A63B 21/225* (2013.01); *A63B 22/0046* (2013.01); *A63B 2022/0652* (2013.01); *A63B 2071/0652* (2013.01); *A63B 2220/24* (2013.01); *A63B 2220/34* (2013.01); *A63B 2220/833* (2013.01); *A63B 2220/89* (2013.01); *A63B 2225/09* (2013.01)

(58) Field of Classification Search

CPC ..... A63B 24/00; A63B 22/0605; A63B 22/0046; A63B 21/008; A63B 2220/833; A63B 2220/24; A63B 2225/09; A63B 2022/0652; A63B 2220/89; A63B 2220/34; A63B 21/015; A63B 2071/0652; A63B 21/225

See application file for complete search history.

(56) References Cited

U.S. PATENT DOCUMENTS

| | | | | |
|---|---|---|---|---|
| 4,770,411 | A * | 9/1988 | Armstrong | A63B 22/0605 482/64 |
| 5,027,303 | A | 6/1991 | Witte | |
| 2008/0096725 | A1 | 4/2008 | Keiser | |
| 2009/0118099 | A1* | 5/2009 | Fisher | A63B 21/0052 482/5 |
| 2010/0248905 | A1* | 9/2010 | Lu | A63B 22/0605 482/57 |
| 2011/0111923 | A1* | 5/2011 | Bacanovic | A63B 22/0605 482/8 |
| 2011/0118086 | A1* | 5/2011 | Radow | A63B 21/00196 482/5 |
| 2013/0019700 | A1 | 1/2013 | Matsumoto | |
| 2013/0345025 | A1* | 12/2013 | van der Merwe | A61H 1/0214 482/7 |
| 2014/0106936 | A1* | 4/2014 | Puerschel | A63B 21/0051 482/6 |
| 2014/0171272 | A1* | 6/2014 | Hawkins, III | A63B 24/0087 482/61 |
| 2014/0296034 | A1* | 10/2014 | Wu | A63B 22/0605 482/7 |

FOREIGN PATENT DOCUMENTS

WO WO2009026604 A2 3/2009

* cited by examiner

*Primary Examiner* — Sundhara Ganesan

(74) *Attorney, Agent, or Firm* — Huffman Law Group, PC

(57) ABSTRACT

An exercise device comprises a flywheel, a driving assembly, a magnet, and an analysis module. The driving assembly drives the flywheel to rotate and comprises two pedals. The user drives the flywheel via the pedals. The analysis module employs an angle sensor and a hall sensor to calculate a symmetry index of the user.

8 Claims, 5 Drawing Sheets

| resistance level / rotational speed(RPM) | LV1 | LV2 | LV3 | • • • • |
|---|---|---|---|---|
| 5 | 150W | 200W | 300W | • • • • |
| 10 | 250W | 350W | 400W | • • • • |
| 15 | 300W | 450W | 500W | • • • • |
| ⋮ | ⋮ | ⋮ | ⋮ | • • • • |

Unit :watt(w)

FIG.3

EXERCISE DEVICE PROVIDING SYMMETRY INDEX

CROSS-REFERENCE TO RELATED APPLICATIONS

The entire contents of Taiwan Patent Application No. 102147450, filed on Dec. 20, 2013, from which this application claims priority, are incorporated herein by reference.

BACKGROUND OF THE INVENTION

1. Field of the Invention

The present invention relates to exercise devices, and more particularly relates to an exercise device providing symmetry index.

2. Description of Related Art

Flywheels typically constitute rotating devices useful for storing rotational energy. A flywheel is a spinning wheel rotor with a fixed axis whereby energy is stored in the rotor as rotational energy. Flywheels have a moment of inertia and thus resist changes in rotational speed. The rotational energy is proportional to the square of its rotational speed.

Gait analysis is the biomechanics systematic study of human motion, using instrument to measure and analyze walk movements. The gait analysis can be used to assess individuals with conditions affecting their ability to walk. Commercial exercise devices have no gait analysis function. Symmetry index has been used to gait analysis to access the condition of recovery.

SUMMARY OF THE INVENTION

In one general aspect, the present invention relates to exercise devices, and more particularly relates to an exercise device providing symmetry index.

In an embodiment of the present invention, an exercise device is provided with a flywheel, a driving assembly, a first magnet, and an analysis module. The driving assembly is used for driving the flywheel and comprises a driving wheel, a connecting member, two cranks, and two pedals, wherein the driving wheel indirectly connects to and drives the flywheel via the connecting member, and each crank has two ends in which one end couples to an axle of the driving wheel and the other couples to one of the two pedals. The first magnet couples to the driving wheel. The analysis module comprises an angle sensor and a hall sensor, wherein the angle sensor is used for measuring the change of angular displacement of the flywheel during a specific period of time and an angular displacement and an angular velocity of the driving wheel are thus obtained, and the hall sensor is used for measuring the location of the first magnet so as to obtain the locations of the two pedals and rotational speeds of the two pedals are obtained, and an output power of left leg and an output power of right leg are obtained by a lookup table, so as to calculate a symmetry index.

In another embodiment of the present invention, a method for measuring a symmetry index of a user operating an exercise device comprising a flywheel, a driving assembly, a first magnet, and an analysis module is provided. The driving wheel drives the flywheel. The driving assembly comprises a driving wheel, a connecting member, two cranks, and two pedals. The driving wheel indirectly connects to and drives the flywheel via the connecting member, and each crank has two ends in which one end couples to an axle of the driving wheel and the other couples to one of the two pedals. The first magnet couples to the driving wheel, and the analysis module comprises an angle sensor and a hall sensor. The method comprises the steps of: measuring the change of angular displacement of the flywheel during a specific period of time by the angle sensor, so as to obtain an angular displacement and an angular velocity of the driving wheel; measuring the location of the first magnet by the hall sensor, so as to obtain the locations of the two pedals and an rotational speed of the two pedals; comparing a lookup table with relationship between resistance level and rotational speed of the pedal, so as to obtain an output power of left leg and an output power of right leg; and calculating a symmetry index by the output power of left leg and the output power of right leg.

BRIEF DESCRIPTION OF THE DRAWINGS

FIG. 3 illustrates a lookup table showing relationship between the resistance level and the rotational speed of a crank of an exercise device according to a preferred embodiment of the present invention.

DETAILED DESCRIPTION OF THE PREFERRED EMBODIMENT

Reference will now be made in detail to those specific embodiments of the invention. Examples of these embodiments are illustrated in accompanying drawings. While the invention will be described in conjunction with these specific embodiments, it will be understood that it is not intended to limit the invention to these embodiments. On the contrary, it is intended to cover alternatives, modifications, and equivalents as may be included within the spirit and scope of the invention as defined by the appended claims. In the following description, numerous specific details are set forth in order to provide a thorough understanding of the present invention. The present invention may be practiced without some or all of these specific details. In other instances, well-known process operations and components are not described in detail in order not to unnecessarily obscure the present invention. While drawings are illustrated in detail, it is appreciated that the quantity of the disclosed components may be greater or less than that disclosed, except where expressly restricting the amount of the components. Wherever possible, the same or similar reference numbers are used in drawings and the description to refer to the same or like parts.

Figure 1A:
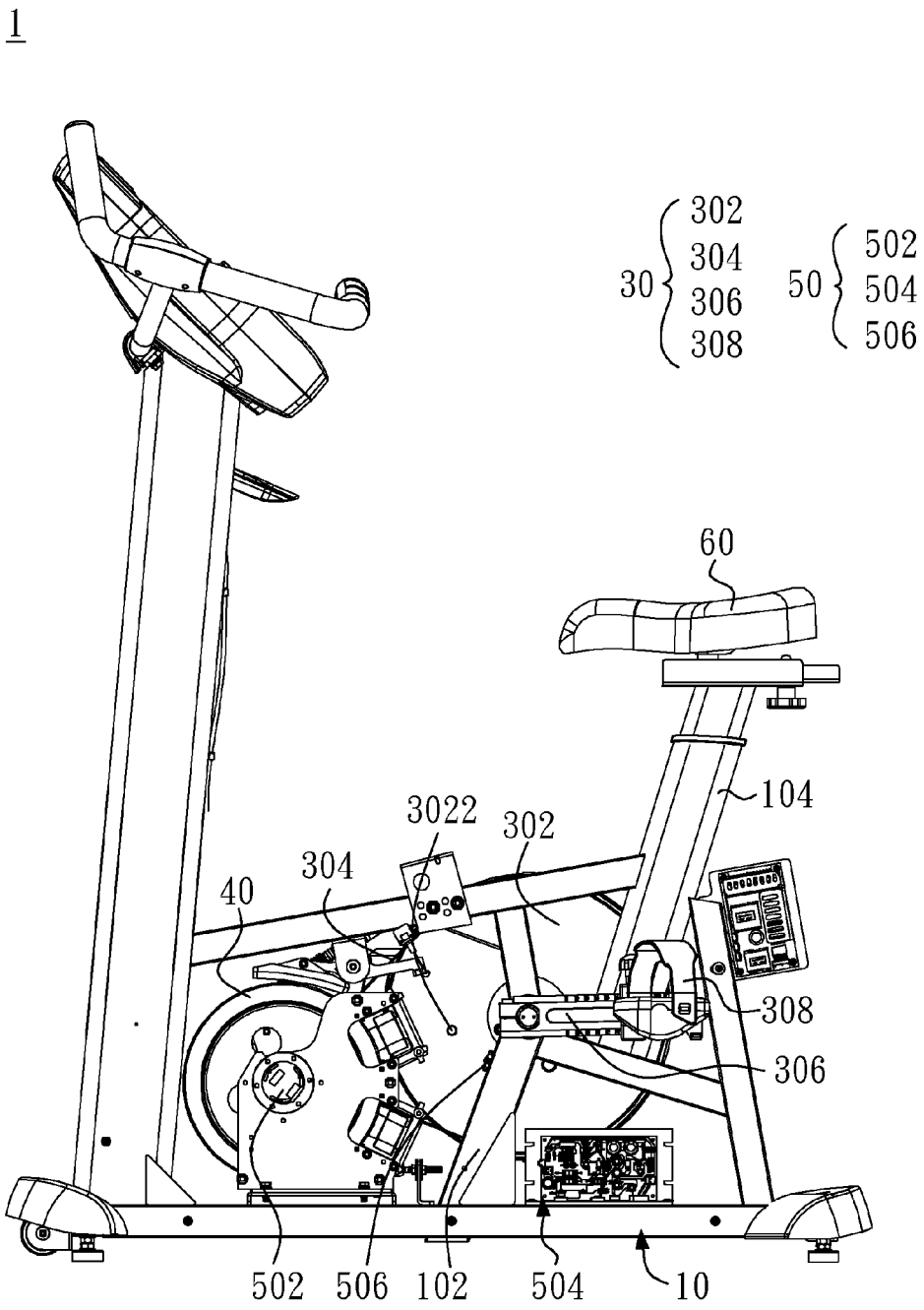
FIGS. 1A and 1B are side view and perspective view showing an exercise device according to a preferred embodiment of the present invention.
Figure 1B:
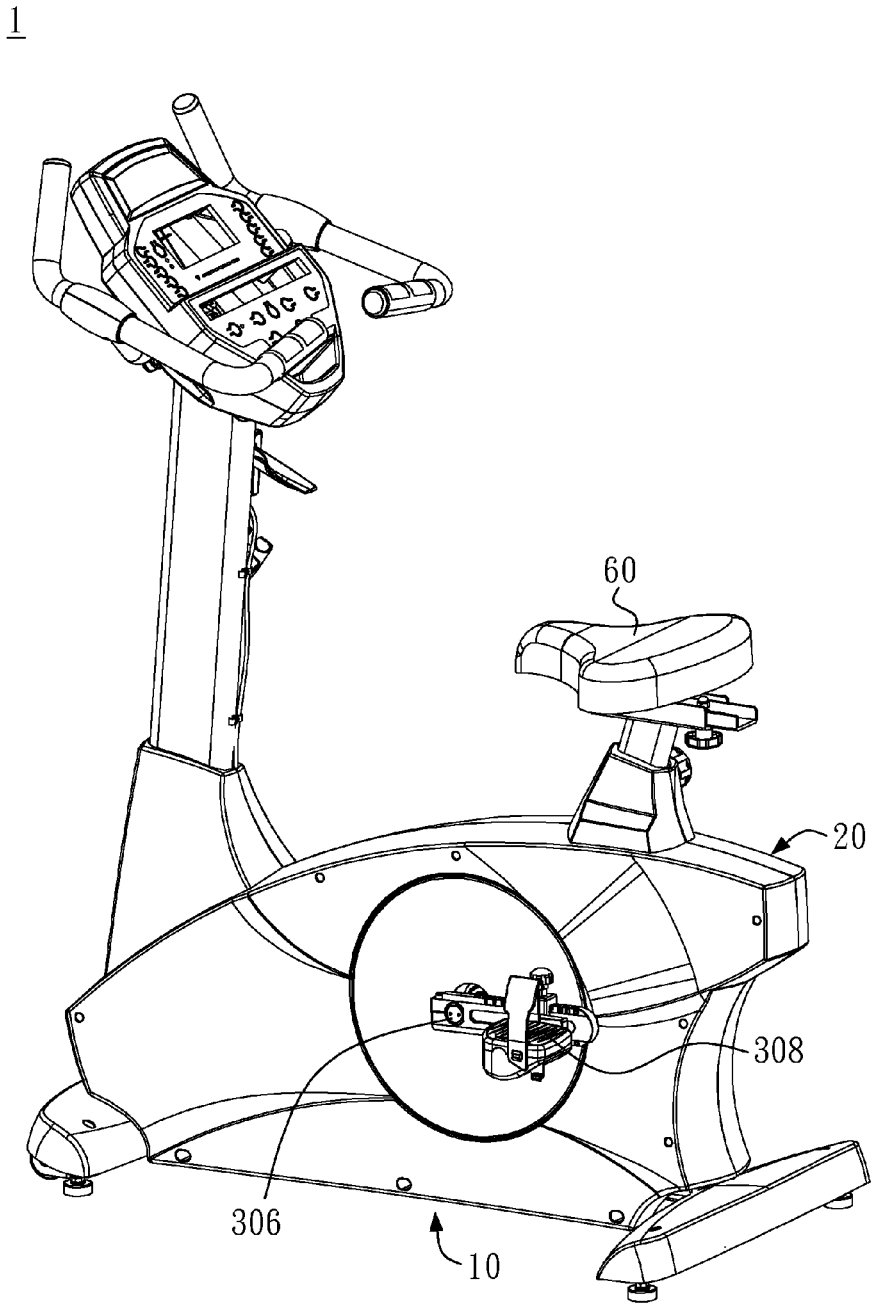

FIGS. 1A and 1B are side view and perspective view showing an exercise device according to a preferred embodiment of the present invention, in which a housing is omitted from FIG. 1B for clearly showing the essential components of the exercise device.

As shown in FIGS. 1A and 1B, the exercise device 1 may comprise a frame 10, a housing 20, a driving assembly 30, a flywheel 40, an analysis module 50, and a seat 60. A user sits on the seat 60 and drives the flywheel 40 to rotate via the driving assembly 30. The analysis module 50 is used to calculate a symmetry index of the user's two legs. The detail is described as follows.

In this preferred embodiment, the driving assembly 30 couples with the frame 10 and may comprise, but is not limited to, a driving wheel 302, a connecting member 304, two cranks 306, and two pedals 308. The frame 10 may comprise, but is not limited to, a bracket 102 and a supporting post 104. The driving wheel 302 may couple with the bracket 102, and the seat 60 may couple with the supporting post 104.

In addition, the driving wheel 302 indirectly connects to and drives the flywheel 40 via the connecting member 304. For instance, a small wheel (not shown) may couple to the flywheel 40 with a common axis, and the small wheel connects with the driving wheel 302 via the connecting member 304. The small wheel and the driving wheel 302 may be, but is not limited to, a pulley, a sprocket, a gear, or a timing pulley, gear, or wheel. The connecting member 304 may be, but is not limited to, a belt, a gear, or a timing gear or a timing belt corresponsive to the driving wheel 302. In this embodiment, the driving wheel 302 and the small wheel are pulley, and the connecting member 304 is a belt.

Further, each crank 306 has two ends, in which one end couples to an axle of the driving wheel 302 and the other couples to one of the two pedals 308.

A user sits on the seat 60 with his or her feet respectively putting on the one of the two pedals 308. When the user simulates to ride a bicycle, the driving wheel 302 drives the flywheel 40 to rotate via the connecting member 304. In this embodiment, the flywheel 40 can rotate in two directions, namely, clockwise and counterclockwise directions.

Figure 2:
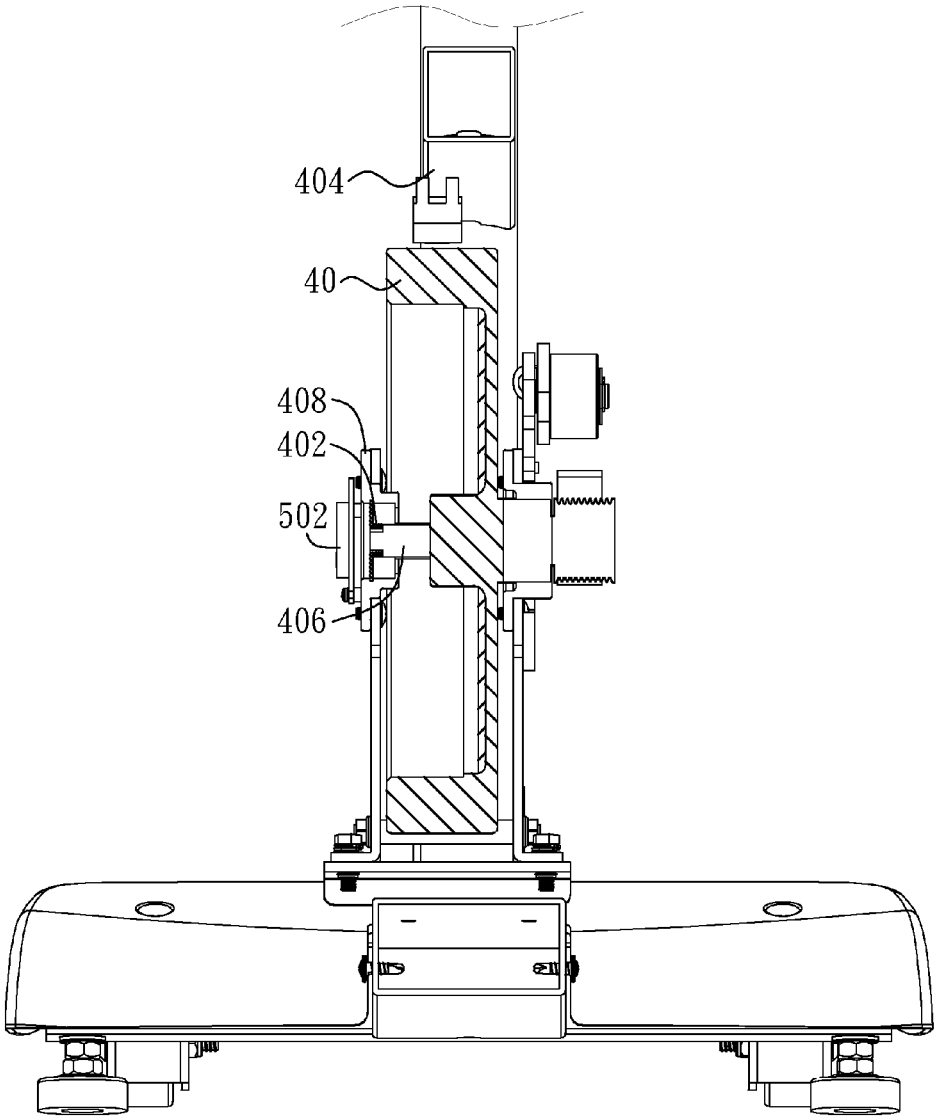
FIG. 2 shows an angle sensor mounted on a flywheel of the exercise device according to a preferred embodiment of the present invention.

Moreover, the analysis module 50 may comprise an angle sensor 502, a hall sensor 506, and a printed circuit board 504. The angle sensor 502 is used to measure the radian or the angle of the rotational movement of the flywheel 40 during a predetermined period of time. The hall sensor is used to measure the location of the cranks 308. The measured results are transmitted to the printed circuit board 504. FIG. 2 shows the angle sensor 502 is mounted on the flywheel 40 of the exercise device according to a preferred embodiment of the present invention. The flywheel 40 couples to a supporter 404. A magnet 402 is mounted on an axle 406 of the flywheel 40, and a surface of the magnet 402 has an N-pole and an S-pole. The angle sensor 502 couples to the supporting piece 408 of the flywheel 40, and the center of the angle sensor aims at the magnet 402 or the axle 406 of the flywheel 40.

Turning to FIG. 1A again, the hall sensor 506 couples to the bracket 102, and a magnet 3022 is arranged at the driving wheel 3022 and simultaneously turns around with the driving wheel 302. The hall sensor 506 can be used to calculate the locations of the two pedals 308. According to the measured result of the angle sensor 502 and the hall sensor 506, the rotational speed of the two pedals 308 can be calculated as follows.

First, a specific location of the magnet 3022 is determined as an initial location. The positions of the magnet 3022 and the pedals 308 can be obtained from the measured results of the angle sensor 502 and the hall sensor 503. For example, a location that the magnet 3022 exactly passes the hall sensor is determined as the initial location of the magnet 3022 (and the pedals 308). The angle sensor 502 measures the radian or the angle of the rotational movement of the flywheel 40 during a predetermined period of time. According to the ratio of the rotational speed of the flywheel 40 to the rotational speed of the driving wheel 302, the radian or the angle of the rotational movement of the driving wheel 302 during the predetermined period of time can be obtained. For example, if the ratio of the rotational speed of the flywheel 40 to the rotational speed of the driving wheel 302 is 9:1, then the driving wheel rotates 25 degree in responsive to the flywheel 40 rotating 225 degree. The magnetic induction flux of the hall sensor 506 depends on the distance between the magnet 3022 and the hall sensor 506, which is continually altered. The location of the magnet 3022 is thus can be estimated. And because the distance between the magnet 3022 and the two pedals 308 are fixed, the location of the two pedals 308 can be obtained. The timing is also recorded when measure the rotational angle and the location of the pedals. Besides, each circle made by the driving wheel 302 has a half contributed by the left pedal and another half contributed by the right pedal. The rotational speed of the left and right pedal can be calculated by the recorded location of the left and right pedal and the timing data.

FIG. 3 illustrates a lookup table with relationship between the resistance level and the rotational speed of an exercise device according to a preferred embodiment of the present invention. An output power of leg can be obtained from a specific resistance level and a specific rotational speed.

Therefore, according to the resistance level currently set by the exercise device and the calculated rotational speed of the left pedal, an output power for left leg of the user can be obtained from FIG. 3. Similarly, according to the resistance level currently set by the exercise device and the calculated rotational speed of the right pedal, an output power for right leg of the user can be obtained from FIG. 3. Notice that FIG. 3 is merely illustrated for exemplary purpose and may be obtained from experimental data or simulation.

Then, a symmetry index is calculated by the following formula:

$$\text{symmetry index} = \frac{2 \times |W_L - W_R|}{(W_L + W_R)} \times 100\%,$$

wherein $W_L$ denotes the output power of the left leg, and $W_R$ denotes the output power of the right leg.

The above-mentioned calculating procedures can be executed in the analysis module 50, such as executed in the printed circuit board 504, while it can executed in other components, such as the display panel. The calculated symmetry index can be also shown in the display panel.

Except the exercise device shown in FIGS. 1A and 1B, the foregoing mechanism and method can be applied to other types of exercise device.

Figure 4:
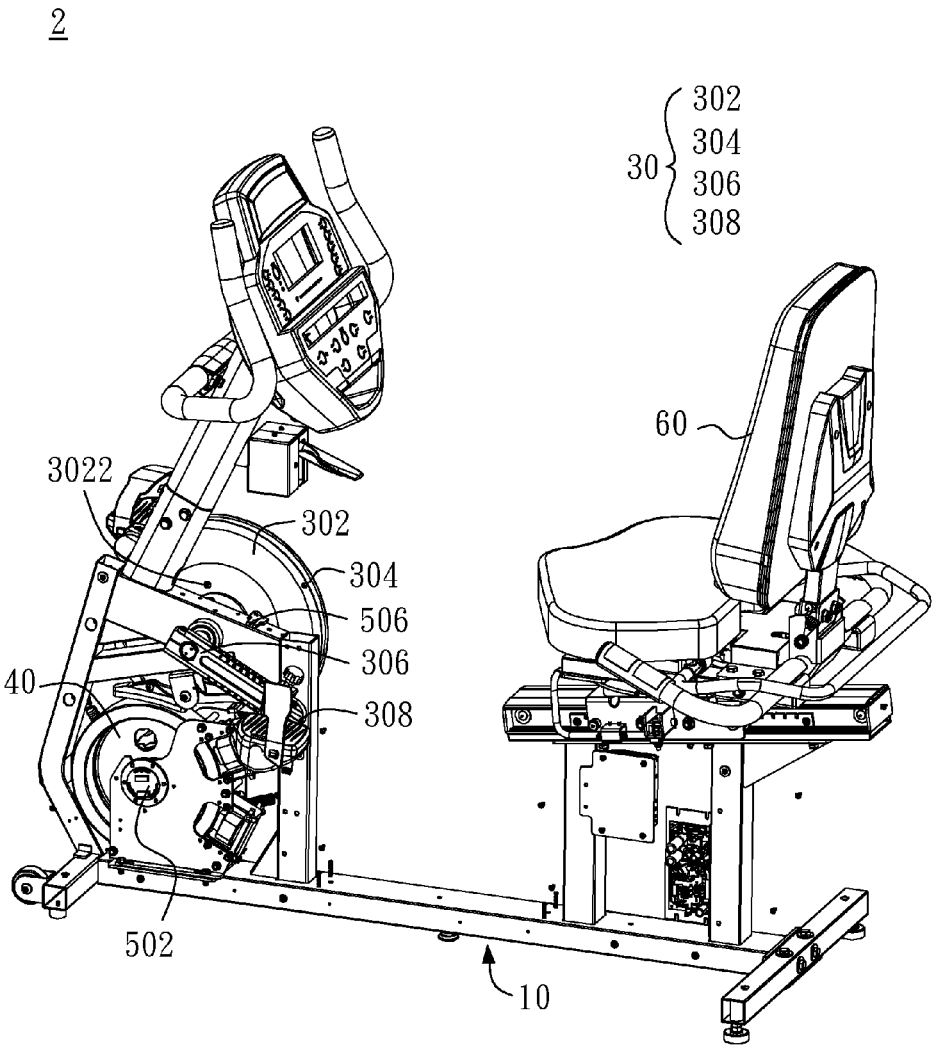
FIG. 4 is a perspective view showing another exercise device according to another preferred embodiment of the present invention.

FIG. 4 is a perspective view showing another exercise device according to another preferred embodiment of the present invention, in which a housing is omitted from FIG. 4 for clarity of essential components of the exercise device.

As shown in FIG. 4, the exercise device 2 may comprise a frame 10, a driving assembly 30, a flywheel 40, an analysis module 50, and a seat 60. The function and the use of those components may be the same or similar to the foregoing embodiment and therefore are omitted.

For a person skilled in the art, alternatives, modifications, and equivalents may be made for the above-mentioned configuration, and those alternatives, modifications, and equivalents are within the scope of the present invention. For example, the driving wheel 302 and the flywheel 40 can be combined as a single wheel in another embodiment. In this case, the angle sensor 502 and the magnet 3022 can be mounted on the single wheel, and the connecting member 304 can be omitted.

Accordingly, embodiments of this invention provide exercise devices and method that can analyze the symmetry index of the user, which can be used to assess individuals with conditions affecting their ability to walk.

The intent accompanying this disclosure is to have each/all embodiments construed in conjunction with the knowledge of one skilled in the art to cover all modifications, variations, combinations, permutations, omissions, substitutions, alternatives, and equivalents of the embodiments, to the extent not mutually exclusive, as may fall within the spirit and scope of the invention. Corresponding or related structure and methods disclosed or referenced herein, and/or in any and all co-pending, abandoned or patented application(s) by any of the named inventor(s) or assignee(s) of this application and invention, are incorporated herein by reference in their entireties, wherein such incorporation includes corresponding or related structure (and modifications thereof) which may be, in whole or in part, (i) operable and/or constructed with, (ii) modified by one skilled in the art to be operable and/or constructed with, and/or (iii) implemented/made/used with or in combination with, any part(s) of the present invention according to this disclosure, that of the application and references cited therein, and the knowledge and judgment of one skilled in the art.

Conditional language, such as, among others, "can," "could," "might," or "may," unless specifically stated otherwise, or otherwise understood within the context as used, is generally intended to convey that embodiments include, and in other interpretations do not include, certain features, elements and/or steps. Thus, such conditional language is not generally intended to imply that features, elements and/or steps are in any way required for one or more embodiments, or interpretations thereof, or that one or more embodiments necessarily include logic for deciding, with or without user input or prompting, whether these features, elements and/or steps are included or are to be performed in any particular embodiment.

Although specific embodiments have been illustrated and described, it will be appreciated by those skilled in the art that various modifications may be made without departing from the scope of the present invention, which is intended to be limited solely by the appended claims.

What is claimed is:

1. An exercise device, comprising:

a flywheel;

a driving assembly for driving the flywheel, the driving assembly comprising a driving wheel, a connecting member, two cranks, and two pedals, wherein the driving wheel indirectly connects to and drives the flywheel via the connecting member, and each crank has two ends in which one end couples to an axle of the driving wheel and the other couples to one of the two pedals;

a first magnet coupling to the driving wheel; and an analysis module comprising an angle sensor and a hall sensor, wherein the angle sensor is used for measuring the change of angular displacement of the flywheel during a specific period of time and an angular displacement and an angular velocity of the driving wheel are thus obtained, and the hall sensor is used for measuring the location of the first magnet so as to obtain the locations of the two pedals and a rotational speed of the two pedals are obtained by the locations of the two pedals and the angular velocity of the driving wheel, and an output power of left leg and an output power of right leg are obtained by a lookup table with relationship between the rotational speeds of the pedal and resistance level of the exercise device, so as to calculate a symmetry index.

2. The exercise device as set forth in claim 1, wherein the symmetry index is calculated by the following formula:

$$\text{symmetry index} = \frac{2 \times |W_L - W_R|}{(W_L + W_R)} \times 100\%,$$

wherein $W_L$ denotes the output power of the left leg, and $W_R$ denotes the output power of the right leg.

3. The exercise device as set forth in claim 1, wherein the flywheel couples to a supporter, a second magnet is mounted on an axle of the flywheel, and a surface of the second magnet has an N-pole and an S-pole.

4. The exercise device as set forth in claim 3, wherein the angle sensor couples to the supporter, and the center of the angle sensor aims at the axle of the flywheel.

5. The exercise device as set forth in claim 1, further comprises a frame and a seat, wherein the frame comprises a bracket and a supporting post, the driving wheel couples with the bracket, and the seat couples with the supporting post.

6. A method for measuring a symmetry index of a user operating an exercise device comprising a flywheel, a driving assembly, a first magnet, and an analysis module, the driving wheel driving the flywheel, the driving assembly comprising a driving wheel, a connecting member, two cranks, and two pedals, wherein the driving wheel indirectly connects to and drives the flywheel via the connecting member, and each crank has two ends in which one end couples to an axle of the driving wheel and the other couples to one of the two pedals, and wherein the first magnet couples to the driving wheel, and the analysis module comprises an angle sensor and a hall sensor, the method comprises the steps of:

measuring the change of angular displacement of the flywheel during a specific period of time by the angle sensor, so as to obtain an angular displacement and an angular velocity of the driving wheel;

measuring the location of the first magnet by the hall sensor, so as to obtain the locations of the two pedals and to obtain a rotational speed of the two pedals by the locations of the two pedals and the angular velocity of the driving wheel;

comparing a lookup table with relationship between resistance level and rotational speed of the pedal, so as to obtain an output power of left leg and an output power of right leg; and calculating a symmetry index by the output power of left leg and the output power of right leg.

7. The method as set forth in claim 6, wherein the symmetry index is calculated by the following formula:

$$symmetryindex = \frac{2 \times |W_L - W_R|}{(W_L + W_R)} \times 100\%,$$

wherein $W_L$ denotes the output power of the left leg, and $W_R$ denotes the output power of the right leg.

8. The method as set forth in claim 6, wherein the flywheel couples to a supporter, a second magnet is mounted on an axle of the flywheel, and a surface of the second magnet has an N-pole and an S-pole.

* * * * *